US005595168A

United States Patent [19]

Martin

[11] Patent Number: 5,595,168

[45] Date of Patent: Jan. 21, 1997

[54] DAMPING APPARATUS FOR AN ARCHERY BOW, HANDLE RISER FOR AN ARCHERY BOW, AND METHOD OF FABRICATING A HANDLE RISER FOR AN ARCHERY BOW

[75] Inventor: Terry G. Martin, Walla Walla, Wash.

[73] Assignee: Martin Archery Inc., Walla Walla, Wash.

[21] Appl. No.: 337,055

[22] Filed: Nov. 10, 1994

[51] Int. Cl.[6] ..... F41B 5/20

[52] U.S. Cl. ..... 124/89; 124/88

[58] Field of Search ..... 124/25.6, 86, 88, 124/89, 23.1; 188/268

[56] References Cited

U.S. PATENT DOCUMENTS

| | | | |
|---|---|---|---|
| 3,670,712 | 6/1972 | Izuta | 124/89 |
| 4,005,858 | 2/1977 | Lochner | 188/268 X |
| 4,085,832 | 4/1978 | Gaines et al. | 188/268 |
| 4,570,608 | 2/1986 | Masterfield | 124/89 |
| 4,706,788 | 11/1987 | Inman et al. | 188/268 X |
| 4,893,606 | 1/1990 | Sisko | 124/89 |
| 5,016,602 | 5/1991 | Mizek | 124/89 |
| 5,273,022 | 12/1993 | Leven | 124/89 |
| 5,339,793 | 8/1994 | Findley | 124/89 |

*Primary Examiner*—John A. Ricci

*Attorney, Agent, or Firm*—Wells, St. John, Roberts, Gregory & Matkin P.S.

[57] ABSTRACT

A damping apparatus for an archery bow includes a semi-solid substance which is attachable to an archery bow. In one embodiment, the semi-solid substance is inserted into an aperture formed in the handle riser and secured in place by a retaining clip. In another embodiment, a double-backed adhesive tape is used to attach the semi-solid substance to any desired location on the handle riser. The present invention also includes a method of fabricating a handle riser incorporating a vibration dampener.

13 Claims, 6 Drawing Sheets

DAMPING APPARATUS FOR AN ARCHERY BOW, HANDLE RISER FOR AN ARCHERY BOW, AND METHOD OF FABRICATING A HANDLE RISER FOR AN ARCHERY BOW

TECHNICAL FIELD

This invention relates to archery bows and accessories therefor, and more particularly to devices for damping vibrations of archery bows.

BACKGROUND OF THE INVENTION

The efficiency of an archery bow is measured by the percent of energy stored in the bow when it is fully drawn that is transferred to the arrow at the time the arrow is released. Archery bow manufacturers are constantly striving to improve the efficiency of a bow so that the maximum possible energy is imparted to the arrow. In spite of many improvements over the years, there are many shortcomings of prior efforts to improve bow efficiency. All of the energy not transferred to the arrow from the bow when the arrow is released is transferred back to the bow, typically in the form of vibrations.

Bow vibrations have several drawbacks. First, the existence of vibration equates to some degree of bow inefficiency. The greater the vibrations, the less efficient the bow. Vibrations also cause noises which are highly undesirable for archery hunters. Since the speed of sound travels much faster than an arrow being launched from a bow, many animals will move upon hearing the sound of an archery bow and either dodge the arrow completely, or potentially move so that a non-lethal shot is achieved. Neither of these situations is desirable for the archery hunter.

Another drawback to bow vibrations is that it will reduce the accuracy of the archer. Vibrations tend to make the archery bow more difficult to grasp and hold, and shorten archery practice sessions.

Many attempts have been made to quiet archery bows. String silencers in the form of rubber or yarn strands are commonly attached to bow strings and cables of archery bows. In addition, a wide range of cable guards and cable guard sliders have been developed to reduce bow noise. Nevertheless, these efforts have prevented only some of the noise from the archery bows. There remains a need, therefore, to develop improved ways to damp the vibrations of an archery bow to reduce noise and increase accuracy for the archer.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

An aspect of the present invention involves an homogenous, damping mass comprising a semi-solid substance, the damping mass being securable to an archery bow; and an attachment device to couple the semi-solid mass directly to a surface of an archery bow, with the semi-solid substance absorbing vibrations imparted to the archery bow when launching an arrow.

Anther aspect of the present invention is characterized by a dampening apparatus for an archery bow, comprising:

an enveloping membrane;

a semi-solid substance retained within the enveloping membrane; and an adhesive externally disposed on a portion of the enveloping membrane to attach the enveloping membrane directly to a surface of an archery bow to dampen vibrations imparted to the archery bow when launching an arrow.

Figure 1:
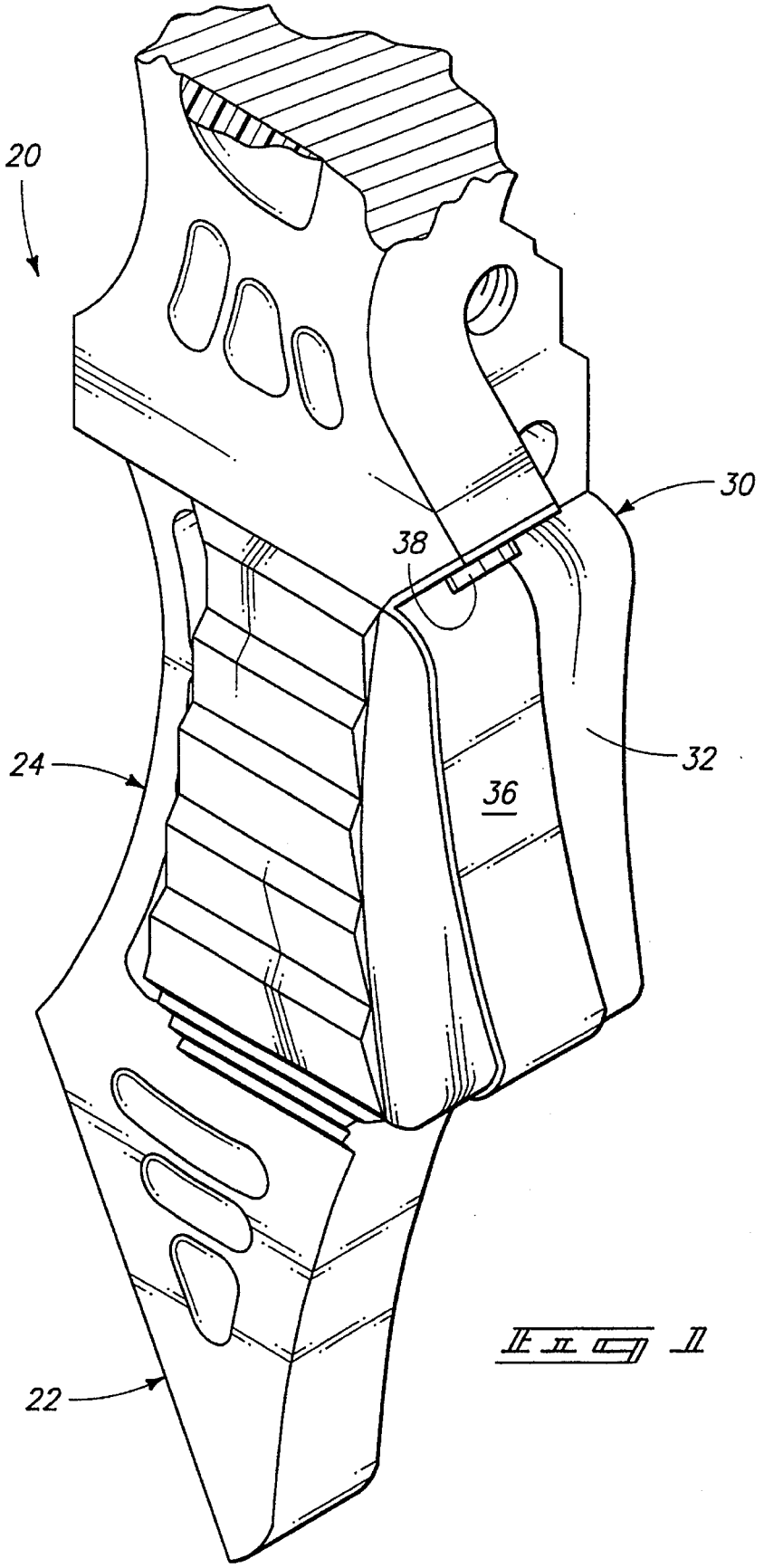
FIG. 1 is an isometric view of a portion of a handle riser incorporating the damping apparatus for an archery bow according to the present invention.

Still another aspect of the present invention is characterized by a method of fabricating a handle riser for an archery bow incorporating a vibration dampener, comprising the following steps:

providing a handle riser for an archery bow having at least one slot therein;

introducing a gelling substance into the at least one slot of the handle riser;

curing the gelling substance within the at least one slot to semi-solidify and securably maintain the gelling substance within the at least one slot, the semi-solidified gelling substance damping vibrations imparted to the handle riser when launching an arrow FIG. 1 shows a portion of a handle riser 20 of an archery bow. Remaining portions of the riser are not shown, as the construction thereof does materially constitute the invention. The handle riser could be any type of handle riser, such as a handle riser for a compound bow, a traditional archery bow, or another type of bow. The handle riser portion 20 shown in FIG. 1 includes an end 22 (a bottom end is shown in FIG. 1, although a top end would be equally suitable) and an intermediate region 24. The specific location of the intermediate region may vary and could be located at any position along the length of the handle riser. The handle portion is longitudinally elongated, as shown.

A damping apparatus 30 is attached to the handle riser 20. The damping apparatus 30 includes a damping mass 32 capable of receiving and absorbing vibrations. The mass 32 preferably is in the form of a homogenous semi-solid substance, such as a gel. The mass 32 may be formed from a liquid or gelling substance that semi-solidifies to form a semi-solid substance. Alternatively, the mass 32 may comprise an outer enveloping membrane which contains a semi-solid or gel substance therewithin. In a preferred embodiment, the semi-solid substance is a urethane gel or rubber. An example suitable material is sold under the trademark AKTON by Action Products of Haggerstown, Md., and is an elastic polymer. Alternate products include any of the rubber kits sold under the trademark Hardness-Shore #10–#13 by PolyTek Development Corp., of Lebanon, N.J. The invention was reduced to practice using Hardness-Shore #10, which produces a softer end-product than any of the #11, #12 or #13 products.

FIGS. 1, and 3–5 discloses the damping mass 32 in the form of a unitary piece that is insertable into the handle riser. The unitary damping mass 32 includes a singular tongue or protruding extension member 42 and an main or outer abutment portion 40. The extension member 42 is inserted into a cavity 34 formed within the handle riser portion 20 such that the outer abutment portion 40 extends outwardly of the aperture 34.

A retaining clip 36 facilitates holding the damping mass 32 inside the cavity 34. The retaining clip 36 includes a lower hook portion 37 which is formed to be placed around the damping mass 32, and a top portion 35 through which a fastener 38 is inserted. The fastener 38 is threadedly received by the handle riser to secure the retaining clip 36 in position.

Figure 2:
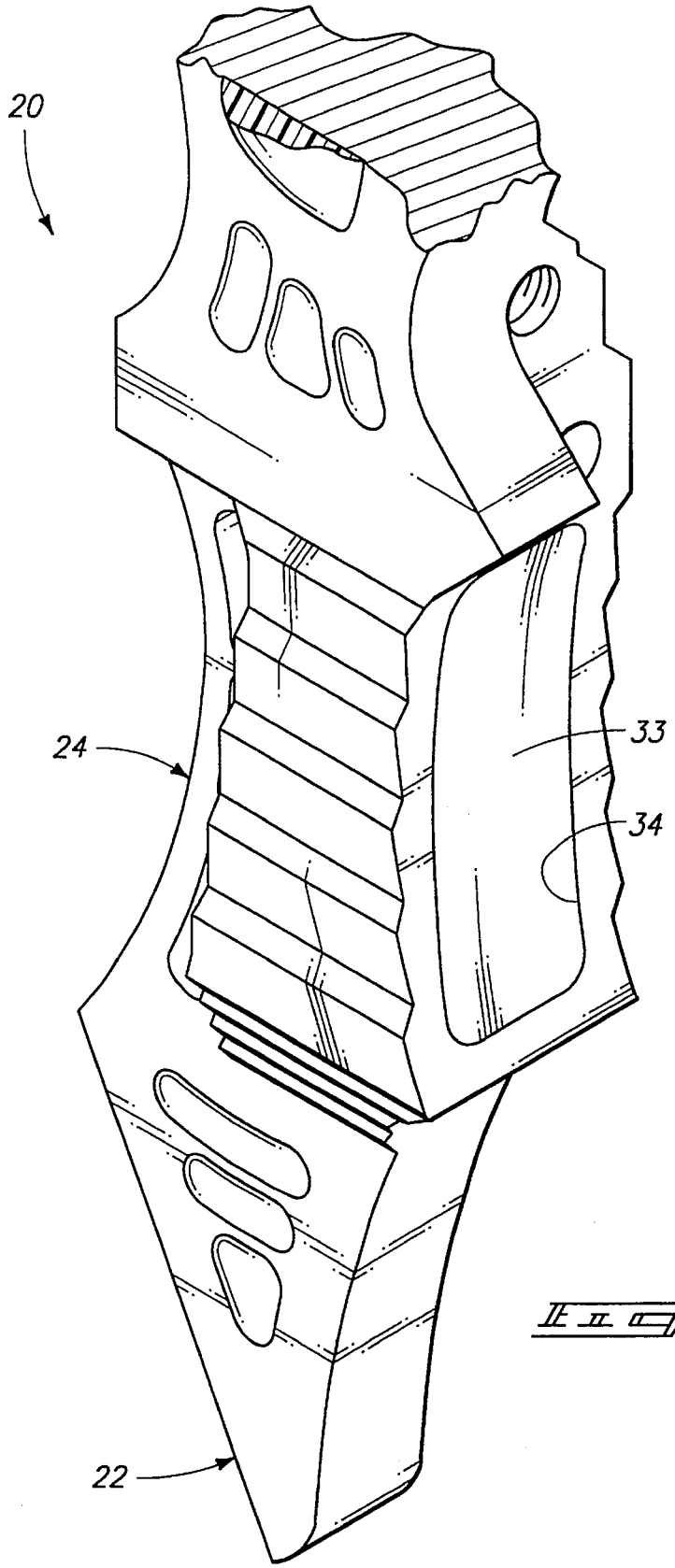
FIG. 2 is an isometric view of an alternative embodiment of a handle riser and damping apparatus for an archery bow according to the present invention.
Figure 3:
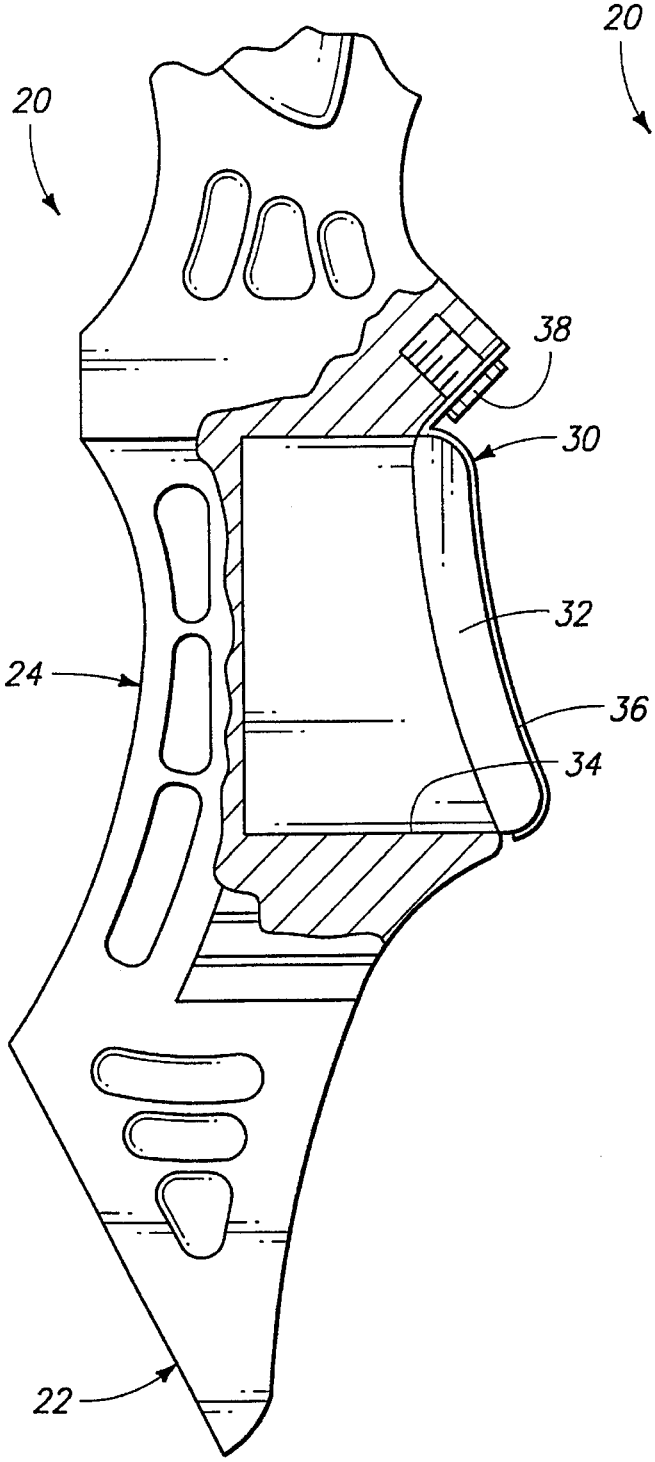
FIG. 3 is a side elevation view, partly in section, of FIG. 1.
Figure 4:
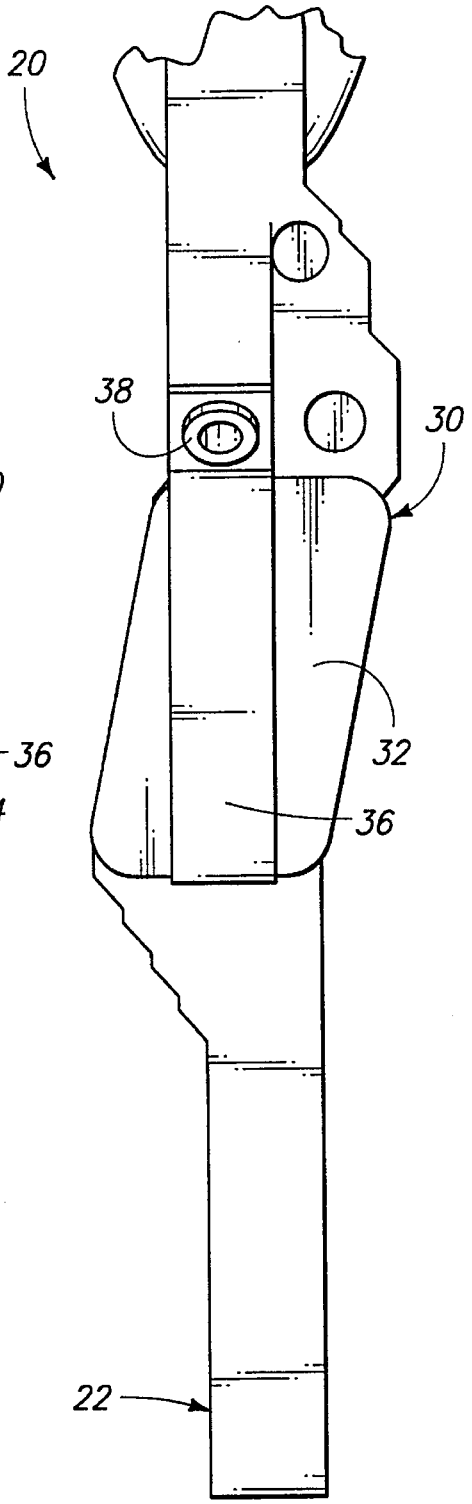
FIG. 4 is a rear elevation view of FIG. 1.
Figure 5:
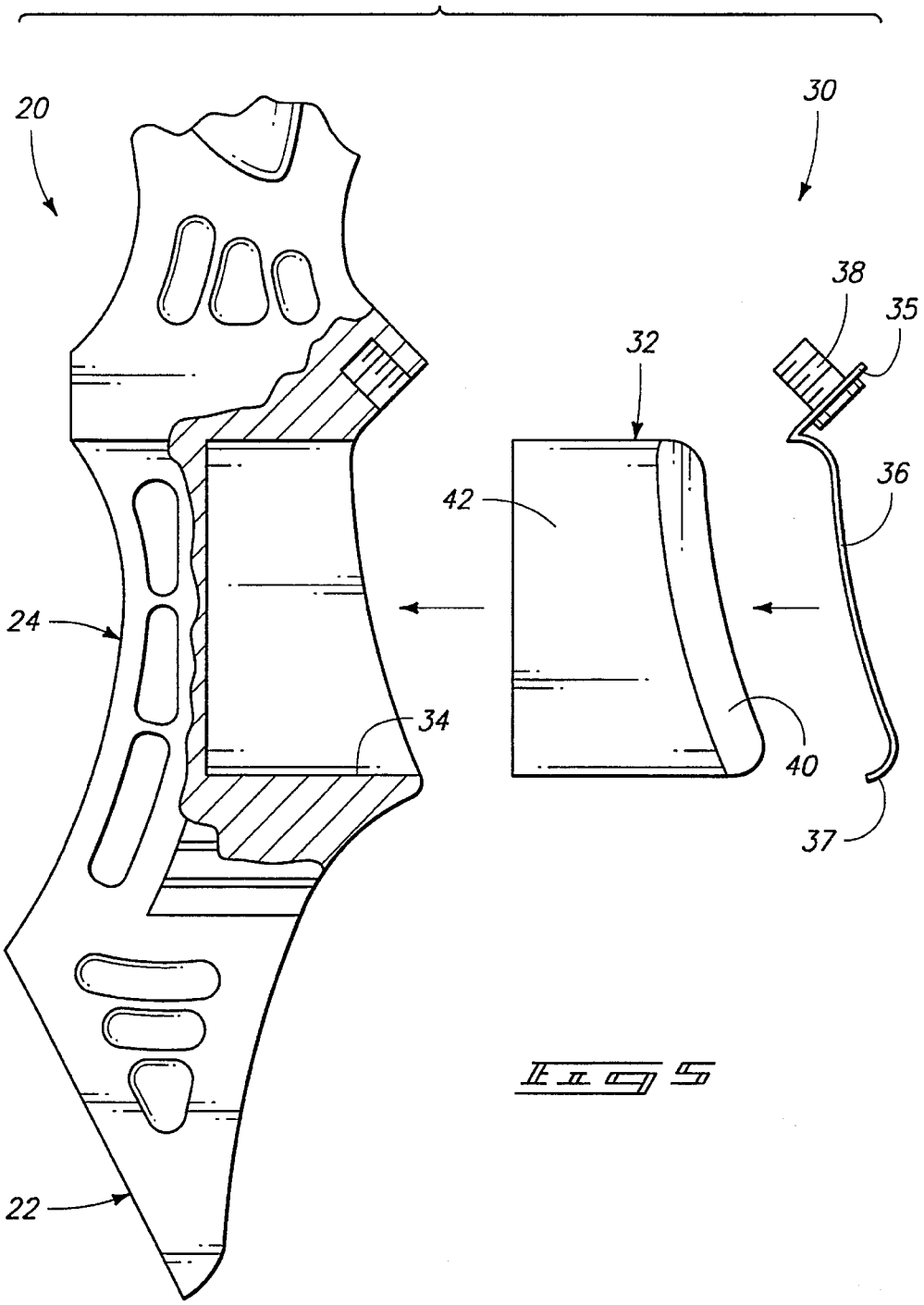
FIG. 5 is an exploded side elevation view of the handle riser and damping apparatus of FIG. 1.

FIG. 2 shows an alternative embodiment handle riser and damping apparatus. A liquid gelling substance 33 is introduced into cavity 34 of the handle riser wherein it is allowed to semi-solidify or cure. Once cured, a semi-solid substance is created which remains in an adhering manner inside the cavity 34 and absorbs vibrations imparted to the bow upon launching an arrow. Any of the Hardness-Shore products above, by example only, could be utilized.

Figure 6:
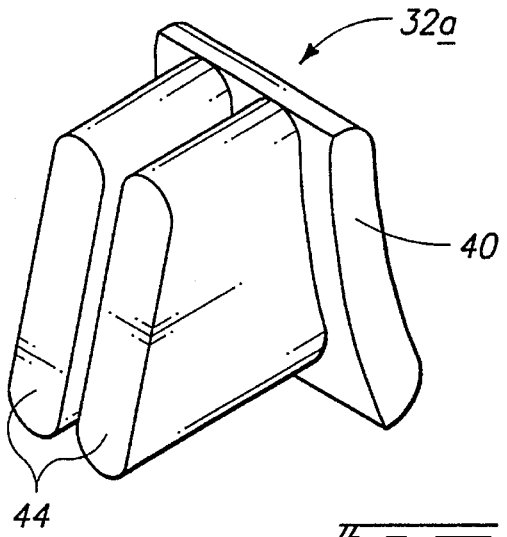
FIG. 6 is an isometric view of the FIG. 1 damping apparatus apart from the handle riser.
Figure 8:
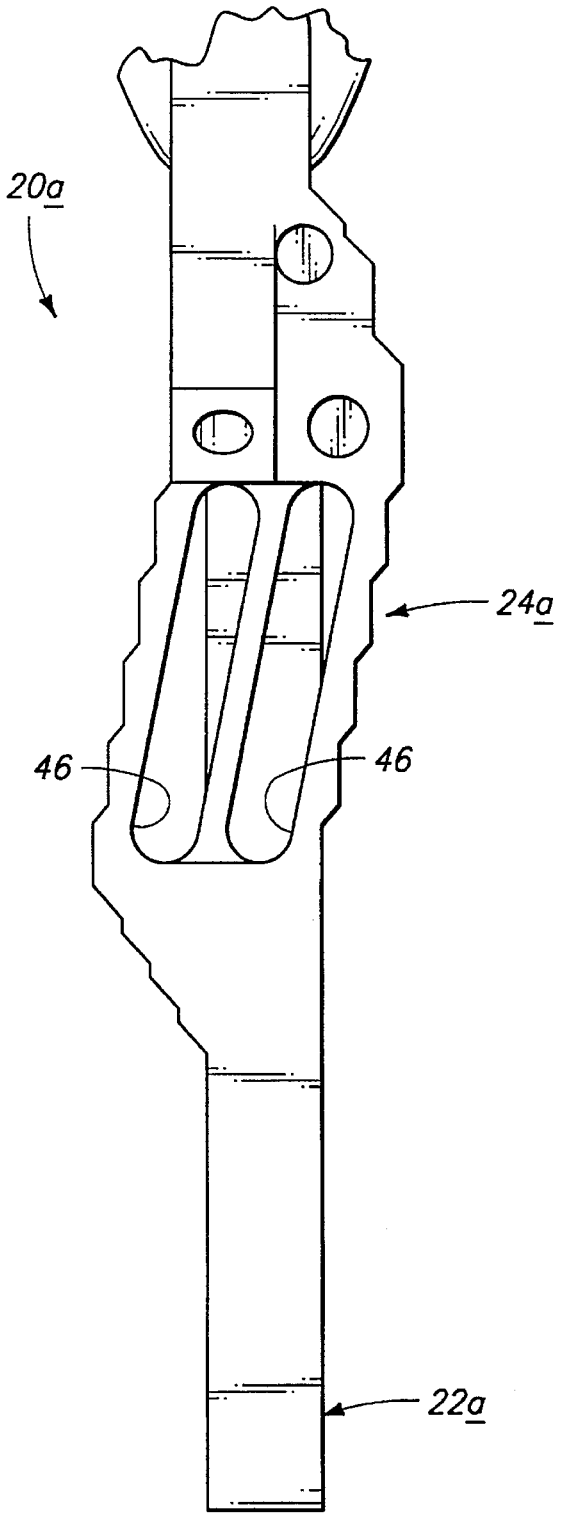
FIG. 8 is a rear elevation view of the handle riser of FIG. 1 including a pair of apertures for receiving a damping apparatus according to the present invention.

FIG. 6 shows an alternative embodiment damping mass **32*a* for utilization with an alternate embodiment handle riser portion 20*a* (FIG. 8). The damping mass in this embodiment includes a pair of protruding extension members 44 which are inserted into a pair of slots or apertures 46 in handle riser 20*a*. Outer abutment portion 40 abuts the rear surface of the handle riser 20*a*. A similar clip 36 (not shown in FIG. 8) can be used to facilitate retaining the damping mass within apertures 46**.

Figure 7:
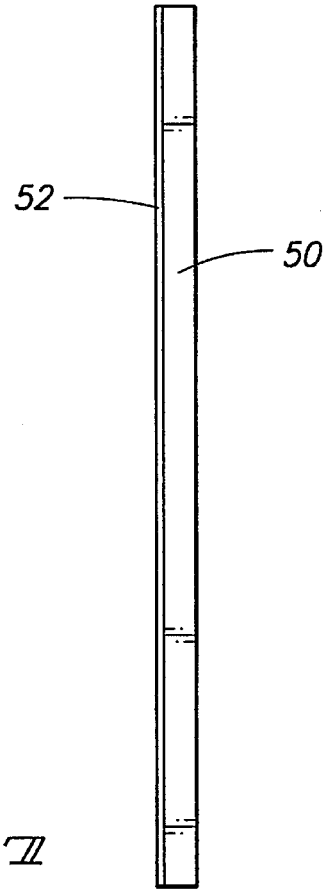
FIG. 7 is another alternative embodiment of the damping apparatus according to the present invention.

Still another embodiment of the invention is shown in FIG. 7. Such comprises a damping mass 50 including a semi-solid substance, such as a urethane gel. The mass 50 could alternately comprise a cured gelling substance or a semi-solid substance held within an enveloping membrane, as described above. A double-backed or sided adhesive tape 52 is attached to one side of the damping mass 50 so that the damping mass can be adhered to any flat surface of the handle riser. The damping mass 50 might be constructed in several separate pieces and placed about the handle riser at various locations.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A damping apparatus for an archery bow comprising:

a homogenous semi-solid damping mass configured to absorb vibrations imparted to the archery bow when launching an arrow; and an attachment device configured to retain the semi-solid mass substantially within a portion of the archery bow.

2. A damping apparatus for an archery bow according to claim 1 wherein the semi-solid mass constitutes a gel.

3. A damping apparatus for an archery bow according to claim 1 wherein the semi-solid mass constitutes a urethane.

4. A damping apparatus for an archery bow according to claim 1 further comprising an enveloping membrane which retains the semi-solid mass.

5. A damping apparatus for an archery bow according to claim 4 wherein the enveloping membrane comprises a main portion and at least one protruding extension member extending from the main portion, the extension being sized and shaped for attachable insertion into a corresponding aperture of the archery bow.

6. A damping apparatus for an archery bow according to claim 5 wherein the aperture in the archery bow comprises a slot in the handle riser and wherein the attachment device comprises a retaining clip to hold the protruding extension member within the slot.

7. A damping apparatus for an archery bow according to claim 1 wherein the attachment device comprises adhesive.

8. A damping apparatus for an archery bow according to claim 1 wherein the attachment device comprises double-sided adhesive tape.

9. A handle riser for an archery bow comprising:

a longitudinally elongated body;

at least one slot formed in the longitudinally elongated body; and a semi-solid substance substantially contained within the slot to dampen vibrations imparted to the handle riser when launching an arrow.

10. A handle for an archery bow comprising:

a longitudinally elongated body;

at least one slot formed in the longitudinally elongated body;

an enveloping membrane having at least one protruding extension member, the protruding extension member being sized and shaped for insertion into the slot in the longitudinally elongated body;

a semi-solid substance held within the enveloping membrane, the semi-solid substance being at least partially contained within the slot and being configured to effectively dampen vibrations imparted to the handle riser when launching an arrow;

attachment means for securing the protruding extension member into the at least one slot.

11. A handle riser for an archery bow according to claim 10 wherein the attachment means comprises a retaining clip to hold the protruding extension member within the slot.

12. A method of fabricating a handle riser for an archery bow comprising the following steps:

providing a handle riser for an archery bow having at least one slot therein;

introducing a gelling substance into the at least one slot of the handle riser;

curing the gelling substance within the at least one slot to semi-solidify and securably maintain the gelling substance within the at least one slot, the semi-solidified gelling substance damping vibrations imparted to the handle riser when launching an arrow.

13. A damping apparatus for an archery bow comprising:

a homogenous semi-solid damping mass configured to absorb vibrations imparted to the archery bow when launching an arrow; and an attachment device configured to retain the semi-solid mass at least partially within a portion of the archery bow.

* * * * *